United States Patent [19]

Rohrbach

[11] 4,287,401

[45] Sep. 1, 1981

[54] MODE-INDICATING MECHANISMS FOR PUSH-BUTTON OPERATED DEVICES

[75] Inventor: William R. Rohrbach, Towaco, N.J.

[73] Assignee: Western Electric Company, Inc., New York, N.Y.

[21] Appl. No.: 95,113

[22] Filed: Nov. 16, 1979

[51] Int. Cl.[3] ..... G09F 9/00; H01H 9/00

[52] U.S. Cl. ..... 200/308; 116/279; 116/303

[58] Field of Search ..... 200/308, 309, 314, 340, 200/310, 311, 313

[56] References Cited

U.S. PATENT DOCUMENTS

| | | | |
|---|---|---|---|
| 3,845,736 | 11/1974 | Golbeck et al. | 200/308 |
| 3,855,959 | 12/1974 | Hinze | 200/308 |
| 4,023,003 | 5/1977 | Arthur et al. | 200/308 |
| 4,052,954 | 10/1977 | Roy | 200/308 |

*Primary Examiner*—Willis Little

*Attorney, Agent, or Firm*—R. F. Kip, Jr.; J. L. Landis

[57] ABSTRACT

An indicating button 10 for a push-push actuated device 11 (e.g., a switch) is mountable on the device's plunger 20 which controls the "on" and "off" states of the device. Button 20 comprises a hollow casing 25 in which is rotatably mounted a quasi-spherical indicator 50 having two surface portions 101, 102 of different appearance which are selectively viewable through a plano-convex lens 90 in the top of the casing at different angular positions of the indicator. The indicator is driven to these different positions at "in" and "out" positions of plunger 20 by a resilient crank arm 70 coupling indicator 50 and device 11 and adapted by resilient bending to convert linear "in" and "out" movements of button 10 and plunger 20 into rotary movements of the indicator.

16 Claims, 9 Drawing Figures

MODE-INDICATING MECHANISMS FOR PUSH-BUTTON OPERATED DEVICES

This invention relates to push buttons for devices actuated by pushing force and in particular to an indicating push button wherein different conditions of the device are indicated by different appearances of part of the button.

BACKGROUND OF THE INVENTION

Indicating push buttons for push actuated devices, such as push-push electrical switches, are used to indicate the operational mode of the devices. For example, U.S. Pat. No. 4,052,954 describes an indicating push button for a push-push electrical switch wherein a visual indicator is rotated (i.e., upon axial movement of the plunger upon which the button is mounted) by means of a push rod linked to the visual indicator by a pin extending through the push rod into a slot in the visual indicator. Indicating push buttons of the foregoing design, however, are relatively expensive and difficult to assemble because of the number of individual elements forming the button. In addition, the pin linkage between the visual indicator and the push rod is susceptible to failure due to wear and the linkage is not easily adapted to use with spherically shaped visual indicators which are preferred for use with devices having round push buttons. An additional problem heretofore encountered with indicating push buttons is the difficulty in observing the rotational mode of the visual indicator when viewing the indicator from the side, i.e., at an angle relative to the axial motion of the plunger upon which the button is mounted. In fact, the problems associated with side viewing have tended to increase the use of electrically activated indicating push buttons notwithstanding the increased energy consumed by such buttons.

SUMMARY OF THE INVENTION

It is, therefore, an object of the invention to provide an inexpensive indicating push button having a relatively small number of constituent parts.

Another object of this invention is to provide indicating push buttons wherein linear motion resulting from pushing of the button can be converted into rotary motion of an indicator therein in a simple, inexpensive, efficient, reliable and durable manner.

It is also an object of this invention to provide an indicating push button having enhanced side viewing.

These and other objects of the invention are realized by providing, for a push force actuated device having a case and a plunger upstanding therefrom and adapted to reciprocate between "out" and "in" stable plunger positions, an indicating push button of the following character. The button comprises a hollow casing providing the outside body of the button and mountable on the plunger for reciprocation therewith. The casing has formed in the base thereof a guideway extending vertically therethrough and, at the top of the casing, there is an optical port permitting viewing into the casing. An indicator is mounted in the casing under the port for rotation about an axis, and the indicator has surface portions of different appearance viewable through the port at different angular positions of the indicator. A vertically extending connecting arm is fixedly secured at its upper end to the indicator in crank arm relation therewith. At its lower end, such arm has fastening means primarily adapted to form part of a coupling of such end and case imposing fixed restraint on relative vertical movement therebetween.

The arm has a lower portion slidably supported within the mentioned guideway and, also, an upper portion resiliently more bendable laterally towards and away from the mentioned axis than is such lower portion. The upper portion is adapted by combined reciprocation and bending thereof to convert up and down reciprocation of the lower portion relative to the casing into rotary movement of the indicator between its mentioned different angular positions.

Other advantageous features of a push button according to the present invention will be apparent from what follows:

BRIEF DESCRIPTION OF THE DRAWINGS

For a better understanding of the invention, reference is made to the representative embodiment thereof shown in the accompanying drawings in which.

DETAILED DESCRIPTION OF STRUCTURAL ASPECTS

Figure 1:
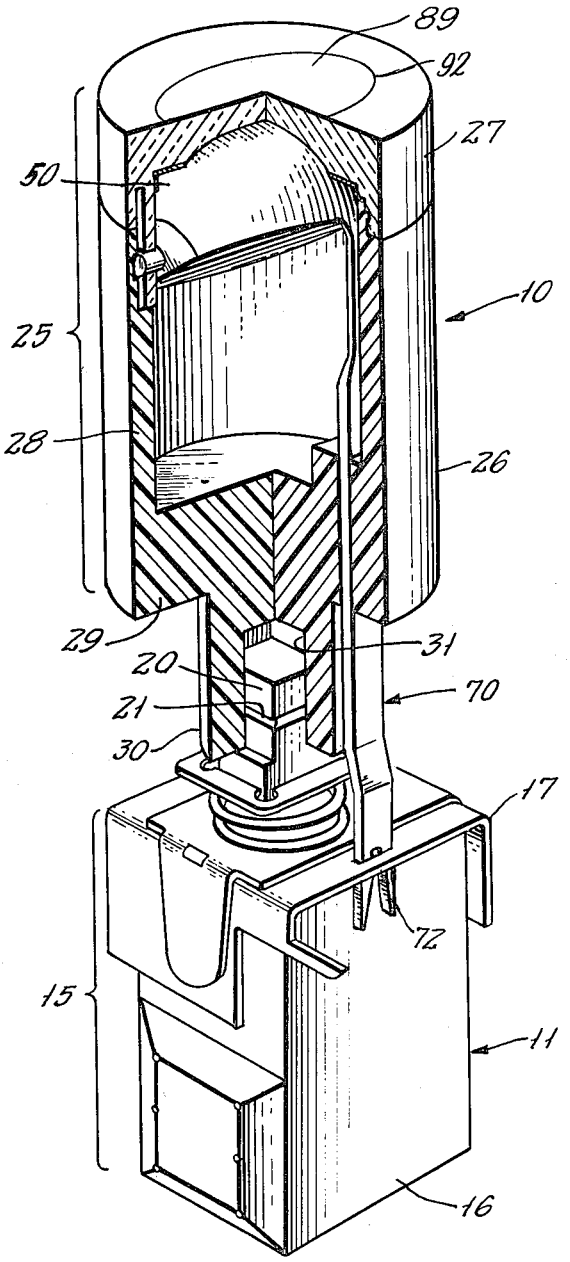
FIG. 1 is an isometric view of an indicating push button in accordance with the present invention and of a device actuated by such button, a portion of such button being cut away to show the interior thereof.

Referring now to FIG. 1, an indicating push button, generally designated by reference numeral 10, is mounted on a device 11 adapted to be controlled by manual application of downward pushing force to the top of button 10. The device specifically depicted in FIG. 1 is a push-push actuated "PB10" electrical switch commercially available by that designation from Centralab Electronics Division, Globe-Union Inc., P.O. Box 858, Highway 20 West, Fort Dodge, Iowa 50501. Since such switch is conventional, there will be described here only those details thereof of which knowledge is helpful in order to understand the structure, operation and advantages of button 10.

The majority of operational parts of switch 11 are not shown in FIG. 1 but are contained within the shown case 15 consisting of a box-like lower housing 16, a bracket 17 on top of such housing and various other metal parts disposed above such bracket. Upstanding from the case 15 is a plunger 20 of a square horizontal cross-section and having a circumferential groove 21 therein. Plunger 20 is slidably mounted in switch 11 to reciprocate relative to case 15 between inward and outward stable positions for the plunger. In FIG. 1, the plunger is shown in its inward position.

Assuming that the plunger is initially in its outward position, it may be drivingly depressed against an outward biasing force thereon to its inward position at which it is held, the plunger in the course of such depression causing switch contacts within device 11 to change condition as, for example, from "open" to "closed" such that switch 11 is "on."

To return the plunger to its outward position, the plunger is again depressed, this time momentarily. Such second depression causes the plunger to be released from its inward position and to be driven by the biasing force thereon back to its outward position. In the course of such outward movement, the mentioned switch contacts are returned to their initially exemplary "open" position such that, at the end of such movement, the switch 11 is "off."

When once returned to the outward position, the plunger is held there by the biasing force thereon. The described cycle of reciprocation of the plunger from its outward to its inward position and then back to its outward position in response to two successive plunger depressions is repeated indefinitely in the operation of the switch 11. The force for effecting such depressions is supplied to the plunger by transmission from button 10 of downward manual pushing force thereon.

Considering now the details of the button 10, the body thereof is in the form of a hollow casing 25 provided by a lower housing 26 and an upper cap 27 serving as a top closure means or end cap for such housing.

The upper part of housing 26 is in the form of a hollow cylinder open at its top and defined by a vertically extending annular wall 28 bounding the interior of the cylinder. A base section 29 of the housing extends across the bottom of such cylinder to form a transverse wall providing a bottom end closure for such interior. Depending from base section 29 is a part of housing 26 in the form of a vertical stem 30 having a cylindrical exterior and having formed therein a central vertical channel 31 of square horizontal cross section similar to that of plunger 20. When button 10 is assembled with switch 11, plunger 20 is received with a press fit into channel 31 and nib 32 (FIG. 3) instanding from the wall of such channel is forced by snap action into the groove 21 of the plunger. In this way, casing 25 is mountable on plunger 20 for reciprocation therewith relative to the case 15 of the switch 11.

The cap 27 of housing 26 is a structure constituting essentially of a single body of transparent synthetic resinous material. Such cap (FIG. 3) is in the form of a hollow cylindrical member open at its bottom, closed at its top by a substantial planar transverse wall 40 of such material and constituted between bottom and top by a vertically extending annular wall 41 of such material enclosing the hollow interior of such cap. To permit assembling of cap 27 with housing 26, such housing has at its top an annular upstanding rim 42 of reduced exterior diameter relative to the remainder of housing wall 28, and such cap has at its bottom a matching annular downstanding rim 43 of enlarged interior diameter relative to the remainder of cap wall 41 and adapted to fit with a press fit on housing rim 42. An annular bead 44 is horizontally outstanding from housing rim 42 at a vertically intermediate position thereon. Such bead is matched by an annular groove 45 formed on the inside of cap rim 43. To assemble the cap and housing, the former is pressed down on the latter to force cap rim 43 down over and around housing rim 42 until bead 44 snaps into the groove 45 to securely hold the cap on the housing.

Figure 6:
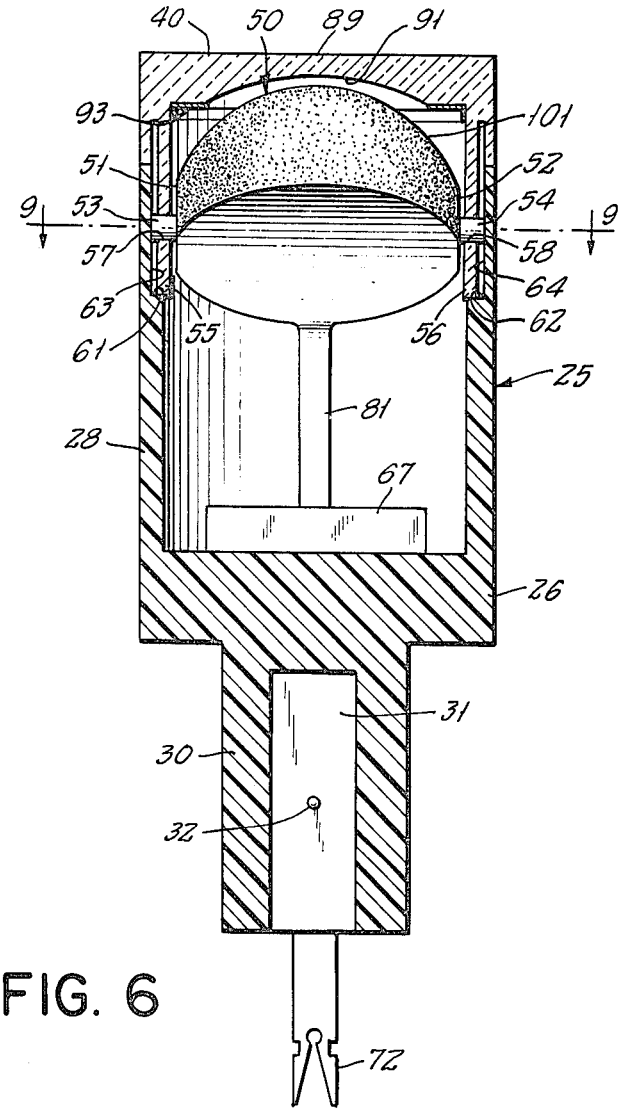
FIG. 6 is a side elevational view in cross section of such button when separated from such device, such view being taken as indicated by the arrows 6—6 in FIG. 2.

Disposed within casing 25 is an indicator 50 (FIG. 6) generally in the form of part of a sphere. More specifically, the body of indicator 50 is in the form of an oblate, substantially hemispheroidal ball 50 having flattened poles 51–52, being that larger portion of a sphere which is left when it is cut in a plane parallel to the sphere's polar axis and somewhat offset therefrom and when, in addition, a segment is removed at each of the sphere's poles from such larger portion to form end flats 51, 52 normal to such axis and, also, similar cylindrical stub portions or shafts 53, 54 coaxial with such axis are then added to such flats to respectively project therefrom.

Figure 9:
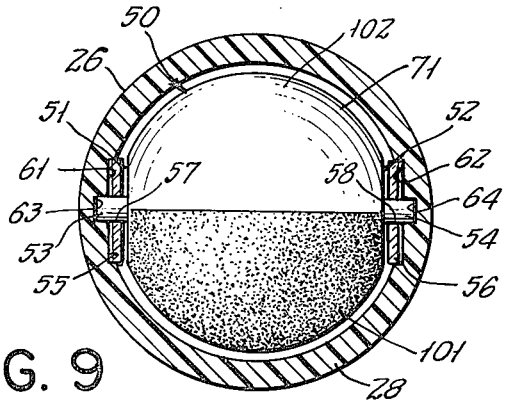
FIG. 9 is a plan view in cross section of the button as shown in FIG. 6, such plan view being taken as indicated by the arrows 9—9 in FIG. 6.

Indicator 50 (FIGS. 6 and 9) is rotatably mounted within casing 25 for free rotation about the polar axis (84) in the following manner. The cap 27 has, as portions thereof, a pair of transversely spaced projections or legs 55, 56 formed of the transparent synthetic resinous material of the cap and extending downwardly below the rim 43 thereof. Such legs 55, 56 have formed therein at the same level below such rim a pair of respective cylindrical apertures or bearing sockets 57, 58 extending horizontally through the legs. When cap 27 is detached from housing 26, legs 55 and 56 are resiliently spreadable apart beyond their normal transverse spacing to permit respective insertion into apertures 57, 58 of the stub portions 53, 54 of the indicator 50. After such insertion and return of the legs to such normal spacing, the transverse ends of such stub portions project outwardly from the outer sides of the legs 55, 56.

Such stub portions are then received with a close but freely rotatable fit within apertures 57, 58 such that these portions serve for indicator 50 as journals supported by full 360° bearings provided by the portions of legs 55, 56 surrounding the apertures 57, 58. The common axis of journals 53, 54 thus become a transverse axis for rotation (84) thereabout of indicator 50 relative to cap 27, which axis 84 is coincident with the polar axis of the ball 50 and is transverse to the line of button movement. When journals 53, 54 are received as described in bearings 57, 58 with normal transverse spacing between the legs 55, 56 there is a slight clearance between the inner sides of these legs and the flats 51, 52 on indicator 50, but apart from such clearance, flats 51, 52 acts as thrust bearings cooperable with legs 55, 56 to prevent significant sidewise shifting of indicator 50 relative to cap 27. Accordingly, indicator 50 is mounted by cap 27 to remain in substantially fixed translational alignment therewith, so that the ball 50 is mounted both for linear movement with the button 10 and also for simultaneous rotational movement within the housing 26 about the polar axis 84.

For purposes of having assembled therewith the detached assembly consisting of cap 27 and indicator 50, housing 26 has formed in the inside of annular wall 28 thereof a pair (FIGS. 6 and 9) of transversely opposite grooves 61, 62 extending vertically downward from the top of rim 42, and in which legs 55, 56 are adapted to be respectively seated with close fit so as to be partially in, respectively said two grooves. Formed in the bottoms of grooves 61, 62 are a pair of narrower, parallel, vertically co-extensive slots 63, 64 of a width and depth for accomodating with clearance all around the ends of journals 53, 54 projecting transversely beyond the outer sides of legs 55, 56. In the course of assembling the cap and housing together, the cap is angularly positioned relative to the housing such that, in the course of downward pressing of the cap onto the housing, the legs 55, 56 slide down with a close fit in grooves 61, 62, and the projecting ends of journals 53, 54 slip down in the slots 63, 64 to come to rest therein with full clearance all around when the cap is snap-locked onto the housing. When the cap is so assembled with housing 26, the close fit of legs 55, 56 in grooves 61, 62 prevents relative rotary movement of the cap and housing about the vertical axis of casing 25 to thereby assure that the said journal ends will remain centered in slots 63, 64 and thus not bind against the sides thereof. Concurrently, legs 55, 56 resiliently press against the bottom surfaces of grooves 61, 62 to cover the slots 63, 64 and, by such abutting relation under resilient pressure with the groove bottoms to be maintained at their normal transverse spacing at which appropriate clearance exists between those legs and the flats 51, 52 on the indicator. The providing of such flats permits the insertion of such legs into the housing 26 without the reduction in the radius of the spherical surface of the indicator which would otherwise be required in order to fit into the limited space in the interior of the housing a more-than-hemispherical body with projecting journals but without end flats.

Turning now to the linkage means for effecting rotary movement of indicator 50, this includes an elongated connector arm 70 mounted in the housing 26 as illustrated, generally parallel to the line of button movement and along an axis 83 spaced from the axis of rotation 84 of the indicator 50 so that an inner segment 81 of the arm is positioned within the housing and an outer segment 80 of the arm projects outwardly from the housing, vertically downward in the example illustrated of a vertically arranged push-button 10. In order to mount the housing 26 for linear movement up and down with respect to the arm 70, the base section 29 (FIG. 3) of housing 26 has formed therein, laterally near annular wall 28, a peripherally closed vertical guideway 65 extending through the base. Guideway 65 is caused to project for a short distance into the interior of housing 26 by a shoulder 66 laterally instanding from wall 28 and by a rib 67 upstanding from base section 29.

Figure 3:
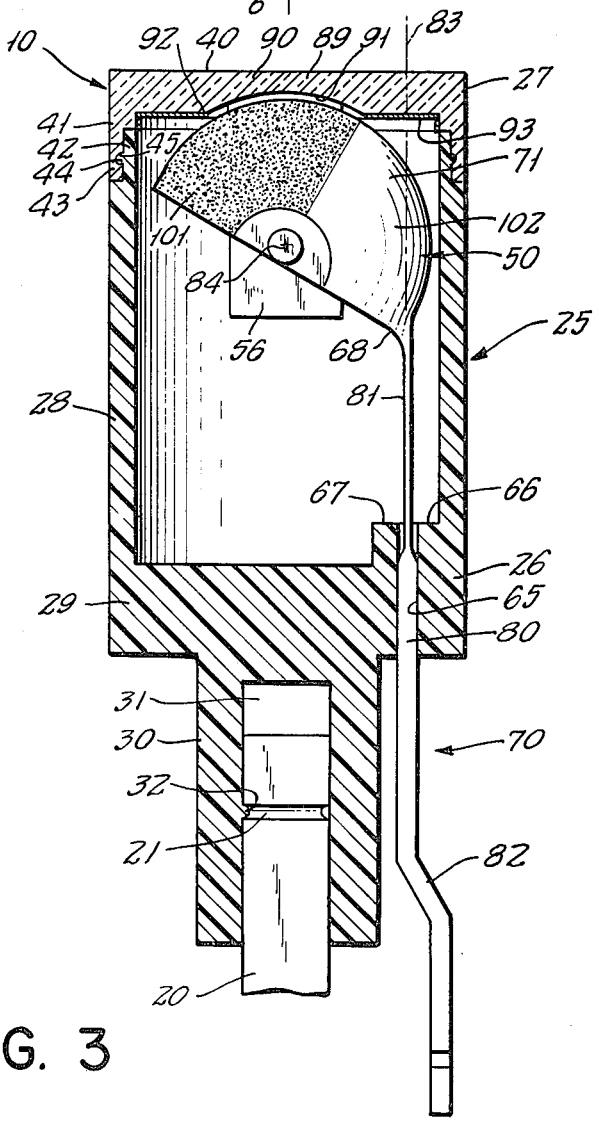
FIG. 3 is a front elevational view in cross section of such button in such position and on such device, such view being taken as indicated by the arrows 3—3 in FIG. 2.

Slidably supported within guideway 65 is an intermediate portion of the connecting arm 70 vertically extending (FIG. 1) from indicator 50 to the case 15 of switch 11, the intermediate portion in the example illustrated being located at approximately the inner (upper) end of the outer arm segment 80 in the initial (off) position of the switch, as illustrated in FIG. 3. Arm 70 is received in guideway 65 with only that amount of clearance necessary to permit free vertical movement of the button housing 26 up and down with respect to the arm 70. Arm 70 is fixedly secured at its top with a region 68 (FIG. 3) of indicator 50 which is preferably at, or immediately adjacent to, and, in the equatorial plane of, the indicator's spherical surface 71 to be radially offset as far as possible from the transverse axis of rotation 84 of the indicator. Such fixed securement may be effected by, for example, bonding, mechanically attaching or otherwise fixedly fastening together an indicator 50 and an arm 70 which are separate parts. Preferably, however, for reasons of economy and durability, the indicator 50 and the arm 70 are, as shown, integrally joined together at region 68 in the sense that the indicator and arm portions joined at that region are parts of a single body of synthetic resinous material.

Figure 7:
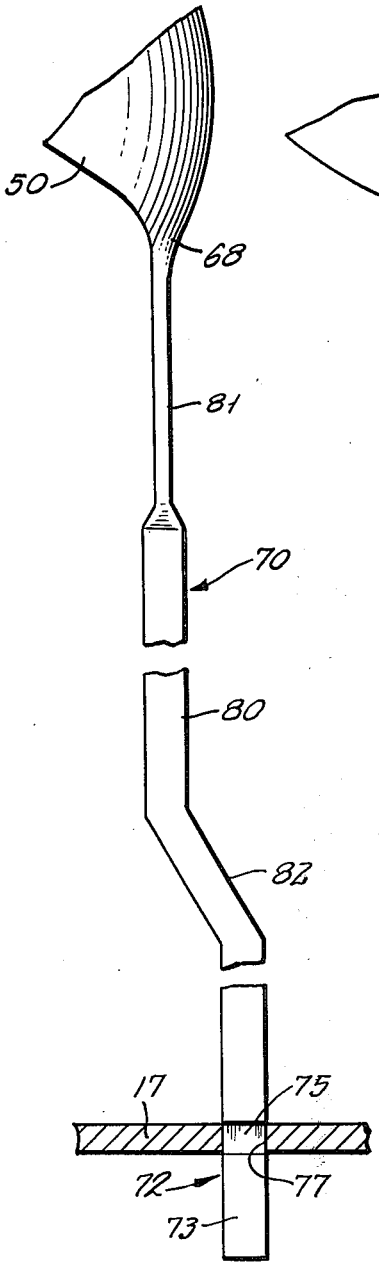
FIG. 7 is a detailed enlarged frontal view of the connecting arm of the button of FIG. 1.
Figure 8:
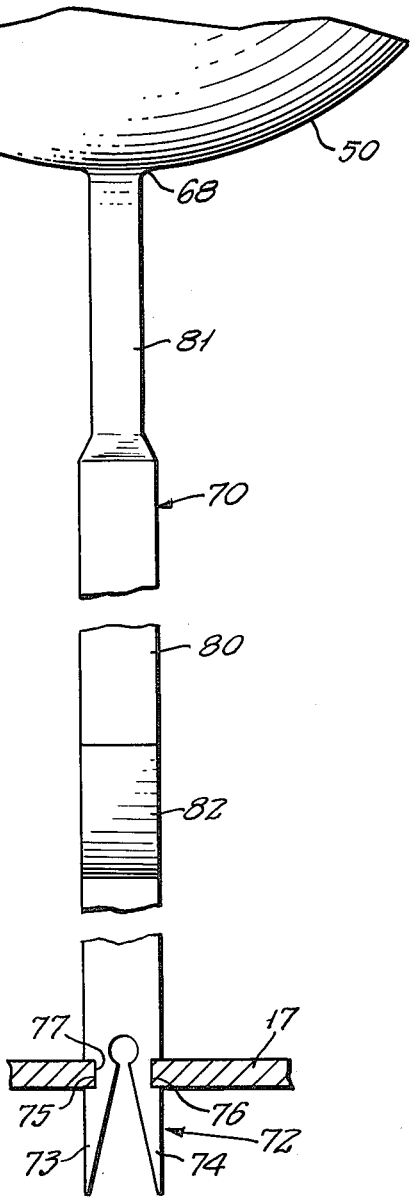
FIG. 8 is a side view of the connecting arm shown in FIG. 7.

Arm 70 is adapted to be connected with case 15 in a manner as follows. At the lower end, arm 70 is provided with fastening means constituted by a bifurcated prong 72 (FIGS. 7 and 8) having two resilient tines 73, 74 with two transversely running notches 75, 76 of rectangular cross section formed in the tines' outer sides. Formed in the bracket 17 of case 15 of the switch is, as an unconventional feature, a square hole 77 having the same lateral dimension (shown in FIG. 7) as the prong but having a transverse dimension somewhat (FIG. 8) smaller than the distance of separation of the inner walls of the notches 75, 76 when tines 73, 74 are unstressed.

To attach arm 70 to case 15, tines 73, 74 are squeezed together to permit insertion of prong 72 into hole 77 to the point at which notches 75, 76 are fully within the hole. Tines 73, 74 are then released and spring resilienty away from each other to cause the notches 75, 76 to receive and engage under resilient pressure, with the portions of bracket 17 which edge hole 77 on its transversely opposite sides. Notches 75, 76 have a vertical dimension matched to the thickness dimension of bracket 17 and moreover, are of sufficient depth such that the engagement of the notches with the bracket couples the lower end of the arm 70 to case 15 by a connection imposing a fixed restraint on translational and angular relative movement in any dimension between the case and the lower end of the arm. Most important is the fixed restraint so imposed on vertical relative movement between such end and such case (except for possibly play due to vertical clearance between notches 75, 76 and the portions of bracket 17 engaged thereby) since the absence of that restraint would not be compensated for by lower portion 80 of the arm being (as it is) also restrained higher up by virtue of being slidably supported in guideway 65.

The arm 70 has between its respective connections with indicator 50 and case 15 a functionally stiff outer or lower segment 80 and an inner or upper segment 81 which is resiliently more flexible in the lateral direction than segment 81 by virtue of having smaller lateral and transverse dimensions than the lower segment. Segment 80 has midway along its length a downward and outward bend 82 to permit that segment to clear various parts of switch 11 and plunger 20 and to be led down to bracket 17 to connect therewith. In operation, the outer segment 80 is fixed to the bracket 17, which may be regarded as a fixed external base member or reference point, and the button housing 26 is adapted to undergo substantially linear reciprocation relative to the fixed outer segment 80 of the arm, with an axis for such reciprocating movement which corresponds to the centerline 83 (FIG. 3) of the guideway 65. Such reciprocation without significant bending is converted by combined resilient bending and reciprocation of upper segment 81 into rotary movement of indicator 50. As shown in FIG. 3, region 68 at which upper segment is joined to indicator 50 is radially offset from the axis of rotation 84 of the indicator by an amount greater than the lateral distance normal to centerline 83 of such centerline from axis 84. Such greater offset of region 68 than the offset from such axis of the centerline of reciprocating movement of the button 10 is advantageous because it increases at mid-positions in the arm's stroke the torque for rotating indicator 50 which is available from the linear force exerted by the arm while, at the same time, permitting the arm to be relatively close to the vertical axis of button 10 to thereby permit minimizing of the button's lateral horizontal dimension. The fact that region 68 is located in the equatorial plane of the quasi-spherical indicator 50 prevents the forces exerted on it by arm 70 from being converted into torque tending to tilt transversely the indicator about its bearings.

Figure 2:
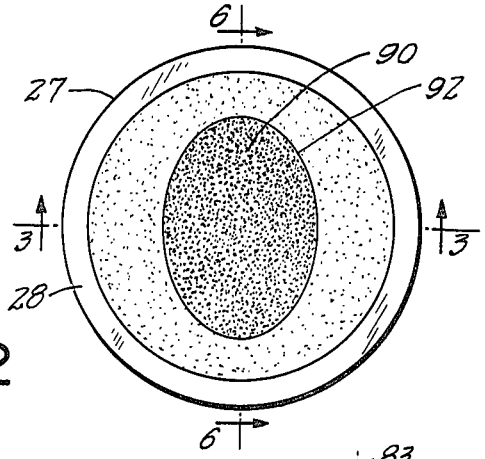
FIG. 2 is a plan view of the button shown in FIG. 1 when such button is in its upward position.
Figure 4:
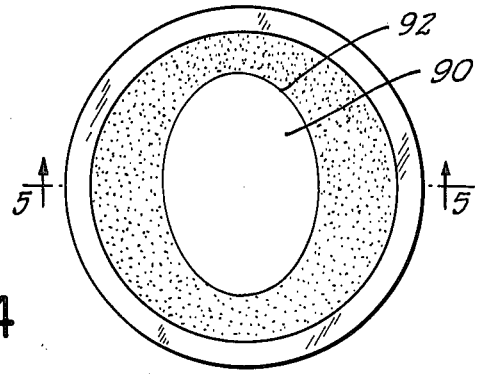
FIG. 4 is a plan view of the button in FIG. 1 when it is in its downward position.

Indicator 50 is adapted to be viewed from above through a transparent viewing area or optical port 89 which is in the described embodiment takes the form of a plano-concave optical lens 90 provided by the cap wall 40 of cap 27 as follows. A concave recess 91 is formed in the underside of wall 40 in a central region thereof in the transparent synthetic resinous material of which such wall is made. As shown by FIGS. 2 and 4, the boundary 92 of such recess may conveniently be of elliptical shape, with the long axis of it the ellipse arranged above and parallel to the axis of rotation 84 of the indicator 50, as illustrated in FIGS. 2 and 3, and so that the short dimension across the ellipse (left-to-right in FIGS. 2–3) extends in the direction of rotation of the surface 71 of the indicator past the lens 90. Surrounding such boundary on, preferably, the underside of wall 40 and on the inside of wall 41 is a mask 93 of opaque material which defines the lens area 90 and which thus limits the visibility through the cap to downwardly within the central region occupied by recess 91. The lens 90 is thus confined to such central region. Such confinement of the lens by mask 93 serves the useful purpose of preventing the seeing through the cap of such a large part of the surface of indicator 50 that ambiguous indications would result.

The upwardly convex spherical surface 71 of indicator 50 is divided into two angularly displaced surface portions 101 and 102 of different appearance. Thus, in the described embodiment, portion 101 is black and portion 102 is white although any other suitable mode for differentiating those portions in appearance may be used.

Figure 5:
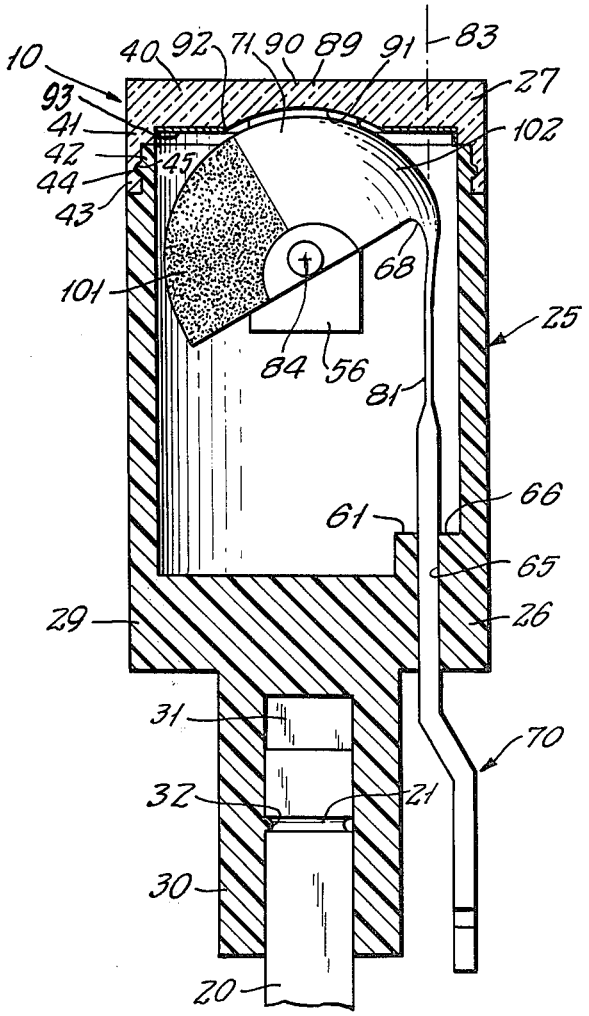
FIG. 5 is another front elevational view in cross section of such button, such front elevational view being taken as indicated by the arrows 5—5 in FIG. 4.

Indicator 50 is so mounted with respect to wall 40 that the convex surface 71 of the indicator projects above the underside of such wall into the concave recess 91 in closely spaced parallelism thereto, as illustrated in FIGS. 3 and 5. It follows that, at different angular positions of indicator 50, different ones of the surface portions 101 and 102 will be received with such recess. The projection of such portions into recess 91 permits those portions to be viewed not only from directly above cap 27 but also from positions for which the line of viewing makes a substantial angle with the vertical axis of casing 25. The ability to see these portions by such "sideward viewing" is, of course, advantageous since it means that the indications provided by these portions can be observed without the observer having to be positioned directly over the button. By well known laws of optics, the fact that optical viewing port 89 takes the form of a lens having at least one concave side results in an enhancement of such sideward viewing as compared to what it would be if port 89 had planar top and bottom sides so as to be of the same thickness at its center as at its edges. As used in this application, the phase "optical lens" or simply "lens" is intended to mean a transparent element having at least one curved lens surface and arranged to form an image of focusing rays of light, and preferably a divergent lens as in the plano-concave lens construction 90 illustrated.

Because indicator 50 is mounted directly by cap 27 to be maintained, as described, in translational alignment therewith, the indicator will likewise be maintained thus aligned with lens 90 so as, for example, to minimize the possibility of contact between the surface of the recess and the spherical surface 71 of the indicator.

OPERATION

The described indicating push button 10 is operated as follows when mounted on the plunger 20 of push-push switch 11. Assume that initially the plunger and button are in the "out" position corresponding to an "off" condition of the switch. For such "out" position, the casing 25 and arm 70 will have the relative dispositions shown in FIG. 3, resiliently bendable segment 81 of arm 70 will be straight or have minimum bending, and the arm 70 will hold indicator 50 in an angular position such that black indicator surface portion 101 will be received in recess 91. In those circumstances the indicator as seen through the lens 90 will, as depicted in FIG. 2, appear black to signify that switch "11" is "off."

Assume now that a downward push force is applied to the top of cap 27 so as to drive casing 25 and plunger 20 to the inward stable position of the latter at which switch 11 is "on." In response to such downward driving, the button housing 26 moves linearly downward about the fixed lower segment 80 of arm 70 so as to exert an upward force on the resiliently bendable upper segment 81 of the connecting arm. As the ball 50 so moves linearly downward with the housing, the lower segment 80 does not undergo any significant deformation because it is of relatively stiff construction, and because segment 80 is prevented from moving by virtue of the restraining connection of the lower end of segment 80 with case 15 and the support higher up of the segment by the interior surfaces of the guideway 65 in which the segment 80 is slidably received and supported.

Upper segment 81 of arm 70 responds to the downward linear displacement of the indicator 50 with the casing 25 to undergo in combination relative linear movement and a resilient bending in a lateral-vertical plane normal to the transverse axis of rotation of indicator 50. By virtue of such combined linear movement and bending, segment 81 is enabled to convert the essentially linear downward movement of the indicator 50 against the upper end of segment 80 into rotary movement of indicator 50 despite the fact that segment 81 is fixedly secured to the region 68 of the indicator. Since region 68 is at the radially outward extremity of the indicator, the torque on such indicator from the linear force on segment 81 is maximized consonant with maintaining minimum horizontal dimensions of button 10. As another advantage, segment 81 is, by virtue of being resiliently bendable, able to convert kinetic energy the indicative against movement of the lower segment into stored potential energy of resilient deformation of the upper segment and, by then unbending, to convert such stored energy back into kinetic energy driving the indicator in rotation. In this way, the angular moment of inertia of the indicator will have a lesser effect in impending the downward movement of the push button, and the probability will be lessened of damage being caused to the moving parts of the button when it is pushed down very fast.

Upon completion of the downward movement of the button 10, the stroke of such arm relative to the casing 25 has driven indicator 50 to the angular position shown in FIG. 5, the indicator being held in that position by the arm. In that position, surface portion 102 of the indicator will be received in recess 91 to show white through lens 90 as depicted in FIG. 4 and to indicate by that appearance that switch 11 is "on."

In order to return the switch to the "off" position, a second momentary downward push force is applied by finger to the receiving means for such force, namely the top 40 of cap 27, to cause plunger 20 of switch 11 to be momentarily depressed below its inward stable position. Conventional mechanisms within the switch act in response to such momentary depression to release the holding of the plunger in such position and to cause it to be driven upward by biasing force back to its outer stable position. Concurrently, electrical contacts within the switch are actuated to return it to an "off" condition.

The driving upward of plunger 20 results in a return upward movement of the button casing 25. In the course of such movement, lower segment 80 participates in such movement without significant bending by virtue of being, as described, fixedly secured to case 15 and slidably supported within guideway 65 and further, by virtue of being in tension. Upper segment 81, however, then functions in reverse to rotate the indicator 50 clockwise back to the FIG. 3 position as the button moves linearly upward back to the initial position, and also undergoes concurrent bending to permit the essentially linear motion to be converted into rotary motion of indicator 50.

Upon completion of the return stroke, the indicator 50 has been rotated back to the angular position shown in FIG. 3 to be held there by arm 70. At that position, surface portion 101 is received within recess 91 to show its black color through lens 90 to thereby signify that switch 11 is "off."

The described cycle of down-up reciprocation of plunger 20 and button 10 in response to two successive pushes on the button can, of course, be repeated indefinitely.

DETAILS OF CONSTRUCTION

Some details of construction of the button 10 are as follows.

Except in certain cases for mask 93, the various parts of button 10 are all composed wholly of synthetic resinous material and are formed by conventional injection molding.

Typically, button 10 is intended to be used on either single station or ganged push button switches whose centerline to centerline distance will be less than $\frac{3}{4}$ inches. For that purpose, the button should be approximately $\frac{3}{8}$ inch in diameter and $\frac{3}{4}$ inch in length from the cap 27 to the base of the stem 30 for installations requiring approximately $\frac{1}{2}$ inch from centerline to centerline. In installations where greater centerline to centerline dimensions prevail, button dimensions can be increased proportionately.

Preferably, the cap 27 is formed of a clear plastic material such as an acrylic, polycarbonate or polyvinyl chloride. Acrylic material generally is preferred because of the optical clarity of the material, the reduced price and the moldability. Desirably, lens 90 has a thickness at its edges of approximately 40 mils and concave cavity 91 extends approximately 50% into the thickness of the lens.

As previously discussed in connection with FIG. 3, the interior of the cap is selectively darkened as indicated by reference numeral 93. The mask 93 may be applied by screen coating a paint on the interior surface of the cap, by hot-stamping ink on the interior surface of the cap or by placing on the interior surface of the cap an adhesive backed polyvinyl material which has been die cut to expose the elliptical lens 90. The latter technique is preferred because of the reduced likelihood of contaminating the cylindrical cavity with the coating agent. As can be seen from FIG. 2, the masking coating on the interior of the cap is in the form of an annular zone having a clear elliptical center.

Preferably, the connecting arm is formed of plastic material having a high flexibility. Acetel materials, polypropylene, polyethylene and nylon generally are suitable for use in the arm. In general, a high flexibility and high tear strength is desired for the arm as well as a high elastic limit.

Typically, the indicator 71 would be painted after molding to provide two quadrants of different colors or otherwise differing in appearance. In those instances, however, when a colored plastic is desired to be used, the rotary member can, as disclosed in U.S. Pat. No. 4,023,003, be formed of two diverge quadrants which would be snapped together to provide the hemispherical rotary member.

The housing 26 is preferably formed of acrylonitrile-butadiene-styrene (ABS), nylon or another material having high strength in thin sections, easy moldability and good as-molded surface luster.

While specific embodiments of the invention have been described in detail above, it should be obvious that various modifications may be made of those details without departing from the spirit and scope of the invention.

What is claimed is:

1. In combination with a mode-indicating mechanism for a two-position, push-button operated device of the type having a reciprocable operating plunger linearly movable by the push button from an outer position to an inner position and back, the push button including a housing mounted to the plunger for operating the plunger and having an open outer end; an end cap fastened to the open end of the housing and having a transparent viewing area through which an operator can inspect interior portions of the housing adjacent to the viewing area; a mechanical indicator mounted in the housing for linear movement therewith and for rotation about an axis transverse to the line of button movement, the indicator having a curved outer surface positioned adjacent to the viewing area that can be rotated past the viewing area to either of two stable positions I and II, depending on the mode of operation of the device, said outer curved surface having portions that are differently colored or otherwise marked such that the operator can determine at a glance the mode of operation of the device by looking into the viewing window; and linkage means, connected to the indicator and operated by linear movement of the button, for rotating the indicator from position I to position II, and back, in response to movement of the button, the improvement wherein the linkage means comprises:

(a) an elongated connector arm mounted in the housing generally parallel to the line of movement of the button and along an axis spaced from the axis of rotation of the indicator so that an inner segment of the arm is positioned within the housing and an outer segment of the arm projects outwardly from the housing, the inner segment of the arm being resiliently bendable compared to the outer segment;

(b) a fixed base member externally located with respect to the button and adjacent thereto;

(c) means for fixedly securing the outer segment of the arm to the base member so that the outer segment is fixed against movement with the button, the housing having a guideway for slideably receiving an intermediate portion of the arm so that the housing can reciprocate in and out with respect to the arm; and (d) means for mechanically attaching the inner segment of the arm to a peripheral region of the indicator radially offset from the axis of rotation, so that linear movement of the button and indicator therewith with respect to the arm causes the inner segment of the arm to flex and to operate as a resilient crank arm for rotating the indicator from position I to position II, and vice versa.

2. A mechanism as recited in claim 1, wherein the end cap includes an optical lens portion located at a central region of the cap and defining the viewing area, the lens portion having at least one curved lens surface arranged so as to enhance viewing of the indicator from positions at an angle to the line of movement of the button.

3. A mechanism as recited in claim 2, wherein the lens portion comprises a plano-concave lens having a flat outer surface facing the operator and having a concave inner surface with a curvature similar to that of the curved outer surface of the indicator and arranged in closely spaced parallelism thereto, so that the marked surfaces of the indicator can be rotated past the concave surface of the lens in close proximity thereto to facilitate viewing by the operator.

4. A mechanism as recited in claim 3, wherein the marked surfaces of the indicator and the convex surface of the lens are both spherically curved surfaces.

5. A mechanism as recited in any one of claims 2 to 4, wherein the cap and lens portion are formed from a single piece of transparent plastic, and wherein the lens portion is defined by a mask of opaque material positioned on the inner surface of the cap around the borders of the central lens region.

6. A mechanism as recited in claim 5, wherein the inner boundary of the mask defining the lens area is of elliptical shape.

7. A mechanism as recited in any one of claims 1, 3 or 4, wherein the viewing area of the cap has an elliptical outline as seen by the operator, with the long axis of the ellipse arranged parallel to the axis of rotation of the indicator, so that the short dimension across the ellipse limits the viewing area in the direction of movement of the differently marked surface portions of the indicator so as to minimize the chances of operator seeing both portions at once.

8. A mechanism as recited in claim 1, wherein the indicator comprises an oblate, substantially hemispheroidal ball having flattened poles, and means for mounting the polar portions of the ball for rotation within the housing so that the polar axis of the ball is the axis of rotation of the ball, and so that the ball is mounted for linear movement with the housing and also for simultaneous rotational movement within the housing about the polar axis; and wherein the means for mechanically attaching the inner segment of the arm to the indicator comprises means for mechanical fastening the inner end of the arm to a joint region on the surface of the ball adjacent to the equatorial plane thereof so as to be radially offset substantially as far as possible from the axis of rotation.

9. A mechanism as recited in claim 8, wherein the ball and arm comprise a unitary molded plastic unit with the ball being integrally joined to the arm at the joint region defining a flexible joint between the surface of the ball and the inner end of the arm.

10. A mechanism as recited in claim 8, wherein the means for mounting the ball for rotation include:

a pair of coaxial stub shafts projecting outwardly from the poles along the polar axis thereof; and a pair of bearing sockets formed in spaced portions of the end cap extending inwardly of the button to positions overlapping the desired axis of rotation of the ball, the bearing sockets being located along the axis of rotation for receiving the stub shafts therein for free rotation of the ball within the housing.

11. A mechanism as recited in claim 10, wherein, the spaced portions of the end cap comprise a pair of spaced parallel legs of resilient plastic material, the legs projecting inwardly from the cap toward the button and being arranged in closely spaced proximity to adjacent portions of the interior of the housing, the legs being arranged to snap apart to permit initial insertion of the stub shafts into the bearing sockets, and then to snap back so as to mount the ball to the legs for rotation with respect thereto and clear of the adjacent inner walls of the housing.

12. A mechanism as recited in any of claims 1, 8, 9 or 10, wherein the inner segment of the arm is mechanically attached to the peripheral region of the indicator at a junction point that is radially offset from the axis of rotation of the indicator by a distance greater than the transverse distance between the axis of rotation and the longitudinal axis of the inner segment of the arm.

13. A mechanism as recited in claim 12, wherein the arm comprises an elongated rectangular member of a resilient flexible material, having an outer end segment of relatively large cross section so that the outer end is relatively stiff and does not bend significantly when the button is reciprocated, and having an inner segment within the housing of reduced cross section such that the inner end segment is resiliently flexible so as to flex transversely while causing rotational movement of the indicator.

14. A mechanism as recited in claim 13, wherein the arm is a molded plastic member joined to the indicator by a flexible joint, and wherein the outer end of the arm is fastened to a fixed bracket of the push-button operated device located adjacent to the plunger and directly beneath an outer portion of the housing.

15. A mode-indicating mechanism for a device of the type that is operated by linear reciprocating movement of a hollow push button to at least two different positions, which comprises:

an optical lens having at least one curved lens surface and located along an outer surface of the button so that an operator can inspect adjacent portions of the interior of the button;

mechanical indicator means mounted for rotation within the button adjacent to the lens to at least two different angular positions depending on the linear position of the button;

indicia means marked on the surfaces of the indicator that move adjacent to the lens, so that the operator can determine the state of operation of the device by locking into the lens; and resilient crank means for rotating the indicator within the button in response to linear movement of the button, the crank means including an elongated arm member having an outer end segment secured to a fixed reference point and having an inner end segment mechanically attached to a peripheral portion of the indicator in crank-arm relationship, the inner segment of the arm being resiliently bendable upon movement of the button with respect to the arm so as to provide a resilient flexible crank arm for rotating the indicator.

16. A mechanism as recited in claim 15, wherein:

the indicator means has a hemispherical surface on which the indicia means are marked; and the lens is a plano-concave lens having a concave spherical inner surface with a curvature similar to that of the indicator and arranged in closely spaced parallelism thereto so that the marked surfaces of the indicator can be rotated past the convex surface of the lens in close proximity thereto, whereby the lens facilitates viewing by the operator from positions sideways to the outer surface of the button.

* * * * *